US010343442B2

(12) United States Patent
Tsuchihashi

(10) Patent No.: US 10,343,442 B2
(45) Date of Patent: Jul. 9, 2019

(54) SHEET PROCESSING DEVICE AND SHEET PROCESSING METHOD

(71) Applicants: KABUSHIKI KAISHA TOSHIBA, Tokyo (JP); TOSHIBA TEC KABUSHIKI KAISHA, Tokyo (JP)

(72) Inventor: Hiroyuki Tsuchihashi, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/202,766

(22) Filed: Nov. 28, 2018

(65) Prior Publication Data

US 2019/0092071 A1 Mar. 28, 2019

Related U.S. Application Data

(62) Division of application No. 15/386,525, filed on Dec. 21, 2016.

(51) Int. Cl.

| | |
|---|---|
| ***B41C 1/12*** | (2006.01) |
| ***B42C 1/12*** | (2006.01) |
| ***B65H 37/04*** | (2006.01) |
| ***B42C 9/00*** | (2006.01) |
| ***B65H 43/00*** | (2006.01) |
| ***B65H 31/00*** | (2006.01) |

(Continued)

(52) U.S. Cl.

CPC ..... *B42C 1/12* (2013.01); *B31F 5/06* (2013.01); *B42C 9/0056* (2013.01); *B42C 9/0068* (2013.01); *B65H 31/00* (2013.01); *B65H 35/0066* (2013.01); *B65H 37/04* (2013.01); *B65H 43/00* (2013.01); *B65H 2301/162* (2013.01); *B65H 2301/43821* (2013.01); *B65H 2404/1122* (2013.01); *B65H 2404/1431* (2013.01); *B65H 2404/185* (2013.01); *B65H 2551/18* (2013.01); *B65H 2701/1244* (2013.01); *B65H 2801/27* (2013.01)

(58) Field of Classification Search

CPC ..... B42C 1/12
USPC ..... 399/408
See application file for complete search history.

(56) References Cited

U.S. PATENT DOCUMENTS 5,096,176 A 3/1992 Golicz et al.
5,540,421 A * 7/1996 Ohta ..... B42C 1/12 270/58.09

(Continued)

OTHER PUBLICATIONS

Partial European Search Report dated May 28, 2018, mailed in counterpart European Application No. 17208458.4, 15 pages.

*Primary Examiner* — Anthony H Nguyen
(74) *Attorney, Agent, or Firm* — Kim & Stewart LLP

(57) ABSTRACT

A sheet processing device includes a tape binding processing unit, a paper discharge unit, and a control unit. The tape binding processing unit performs tape binding processing on a sheet bundle. The paper discharge unit discharges the sheet bundle subjected to the tape binding processing onto a paper discharge tray. The control unit is configured to control at least one of the tape binding processing unit and the paper discharge unit, such that a first tape binding of the first bundle of sheets and a second tape binding of the second bundle of sheets are not in contact with each other when the first bundle of sheets and the second bundle of sheets are stacked on the paper discharge tray.

3 Claims, 11 Drawing Sheets

(51) Int. Cl.
*B65H 35/00* (2006.01)
*B31F 5/06* (2006.01)

(56) References Cited

U.S. PATENT DOCUMENTS

| | | | | |
|---|---|---|---|---|
| 5,632,476 | A | 5/1997 | Stauber | |
| 5,897,250 | A | 4/1999 | Hirai et al. | |
| 5,980,676 | A | 11/1999 | Meetze | |
| 6,024,525 | A * | 2/2000 | Yamanaka | B42C 9/0075 412/11 |
| 6,354,059 | B1 * | 3/2002 | Yoshie | B42C 1/125 53/117 |
| 9,469,086 | B2 | 10/2016 | Honegger | |
| 2006/0029445 | A1 * | 2/2006 | Nakamura | G03G 15/6544 399/329 |
| 2006/0038336 | A1 * | 2/2006 | Hirata | B65H 29/58 270/37 |
| 2012/0155993 | A1 * | 6/2012 | Masunari | B42C 9/0056 412/37 |
| 2013/0285304 | A1 | 10/2013 | Awano | |
| 2016/0229164 | A1 | 8/2016 | Taki | |

* cited by examiner

SHEET PROCESSING DEVICE AND SHEET PROCESSING METHOD

CROSS-REFERENCE TO RELATED APPLICATION

This application is a division of U.S. patent application Ser. No. 15/386,525, filed on Dec. 21, 2016, the entire contents of each of which are incorporated herein by reference.

FIELD

Embodiments described herein relate generally to a sheet processing device and a sheet processing method.

BACKGROUND

A sheet processing device that performs specified post-processing on a sheet (paper sheet) conveyed from an image forming apparatus is known. The sheet processing device is provided with a sheet binding mechanism. The sheet binding mechanism may include a stapler which staples the sheets together with a staple or a crimping mechanism which processes a sheet into a tooth or detent shape by pressure to temporarily fix a plurality of such sheets together. After being processed by the stapler or the crimping mechanism, holes from the staple or a tooth or detent shape is left in the sheet and thus the stapler or the crimping mechanism limits the ability to reuse the sheet. In recent years, a method for binding a sheet using an adhesive tape has been considered. However, when a plurality of sheet (bundles) having been adhered together by tape are stacked, the resulting stack of bundles of sheets is influenced by the thickness of the tape. That is, when a plurality of bundles of sheets subjected to tape binding processing are stacked one over the other, the stack height of the stacked bundles is partially increased in the periphery thereof where the tape binding portion is present. When the stacked height of bundles of sheets is excessively increased where the tape binding portions are present, the balance of the stack of bound bundles of sheets may be deteriorated or the stack of bundles of sheets may collapse and drop. Additionally, when the adhesive tapes of adjacent bundles in a stack come into contact with each other, the adhesive layers of the adhesive tape of the respective adjacent bundles may have the adhesive layers thereof adhered to each other. When the adhesive layers of the adhesive tape of adjacent bundles of sheets become adhered to each other, a plurality of bundles of sheets stacked on each other may be adhered to each other and each bundle of sheets will become hard to handle individually.

DETAILED DESCRIPTION

Figure 1:
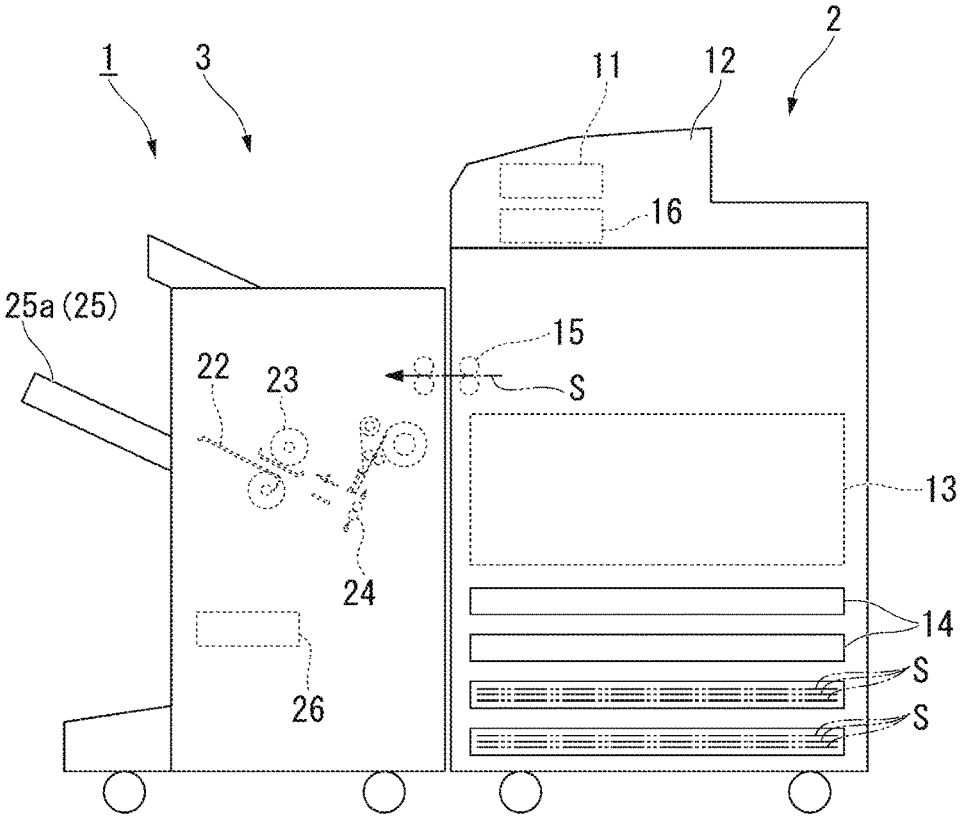
FIG. 1 is a front view illustrating a configuration of an image forming system according to an embodiment.

According to an embodiment, a sheet processing device includes a tape binding processing unit, a paper discharge unit, and a control unit. The tape binding processing unit performs tape binding processing on a sheet bundle. The paper discharge unit discharges the sheet bundle subjected to the tape binding processing onto the paper discharge tray. The control unit is configured to control at least one of the tape binding processing unit and the paper discharge unit, such that a first tape binding of the first bundle of sheets and a second tape binding of the second bundle of sheets are not in contact with each other when the first bundle of sheets and the second bundle of sheets are stacked on the paper discharge tray.

A sheet processing method according to an embodiment, includes performing tape binding processing on a first bundle of sheets, discharging the first bundle of sheets subjected to the tape binding processing to a paper discharge tray, and performing tape binding processing on a second bundle of sheets, discharging the second bundle of sheets subjected to the tape binding processing to the paper discharge tray and onto the first bundle of sheets discharged to the paper discharge tray. The first bundle of sheets and the second bundle of sheets are stacked on each other in the paper discharge tray, such that a first tape binding of the first bundle of sheets and a second tape binding of the second bundle of sheets are not in contact with each other.

In the following, a sheet processing device and a sheet processing method according to an embodiment will be described with reference to the drawings. In the following description, the same reference numerals and symbols are given to elements having the same or a similar function. Redundant descriptions of these elements may be omitted.

Figure 2:
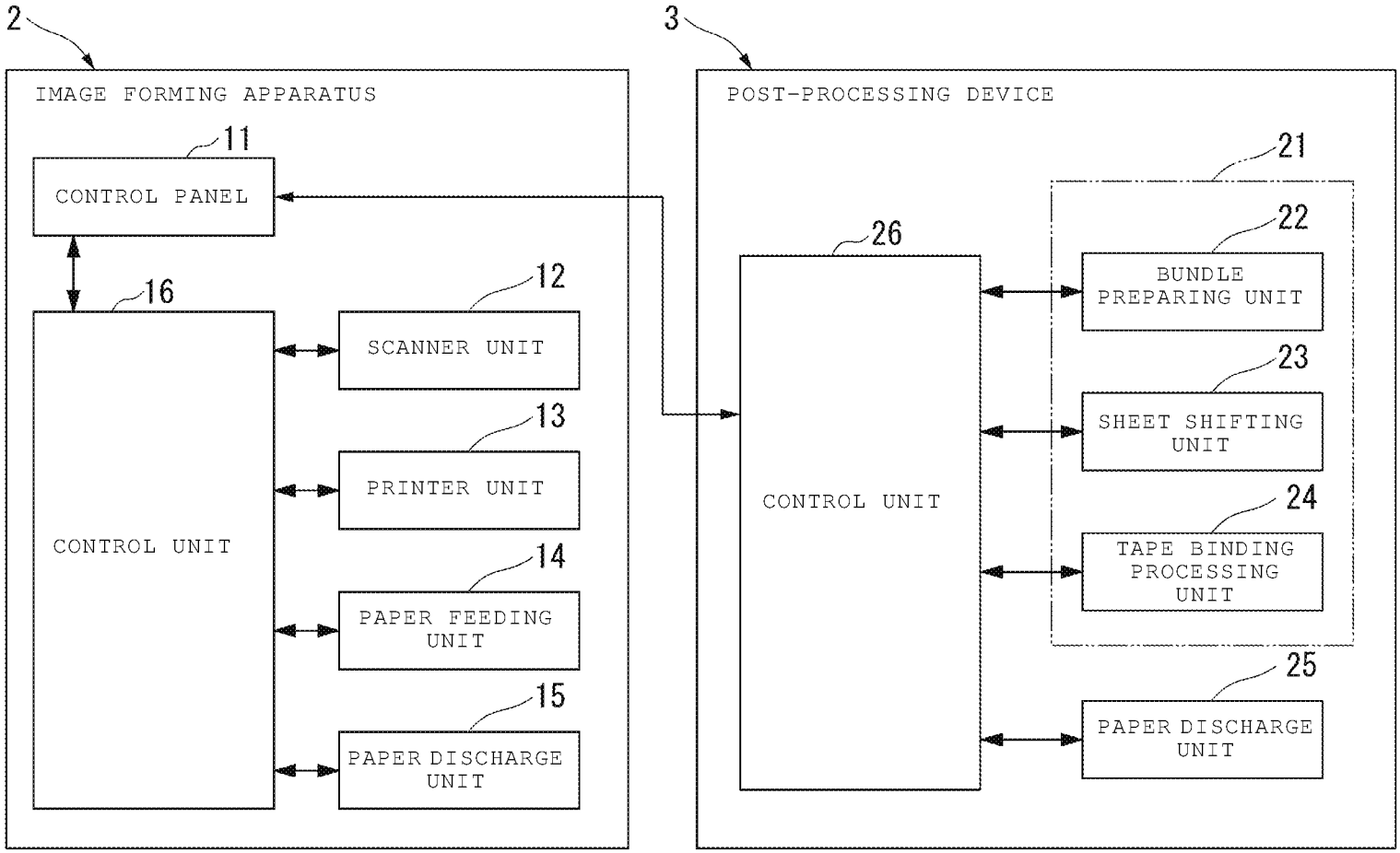
FIG. 2 is a block diagram illustrating the configuration of the image forming system according to the embodiment.

A sheet processing device according to one embodiment will be described with reference to FIG. 1 to FIG. 13. First, FIG. 1 and FIG. 2 illustrate an example of the entire configuration of an image forming system 1. The image forming system 1 includes an image forming apparatus 2 and a post-processing device 3. The image forming apparatus 2 forms an image on a sheet type recording medium such as a paper sheet (in the following, referred to as a "sheet S"). The post-processing device 3 performs post-processing on a sheet S conveyed from an image forming apparatus 2. The post-processing device 3 is an example of a "sheet processing device".

The image forming apparatus 2 includes a control panel 11, a scanner unit 12, a printer unit 13, a paper feeding unit 14, a paper discharge unit 15, and an image forming control unit 16.

The control panel 11 includes various keys, touch panels, or the like, that receive a user's input. For example, the control panel 11 receives a user input regarding the type of post-processing of the sheet S. The image forming apparatus 2 transmits information on the type of post-processing input to the control panel 11 to the post-processing device 3.

Figure 3:
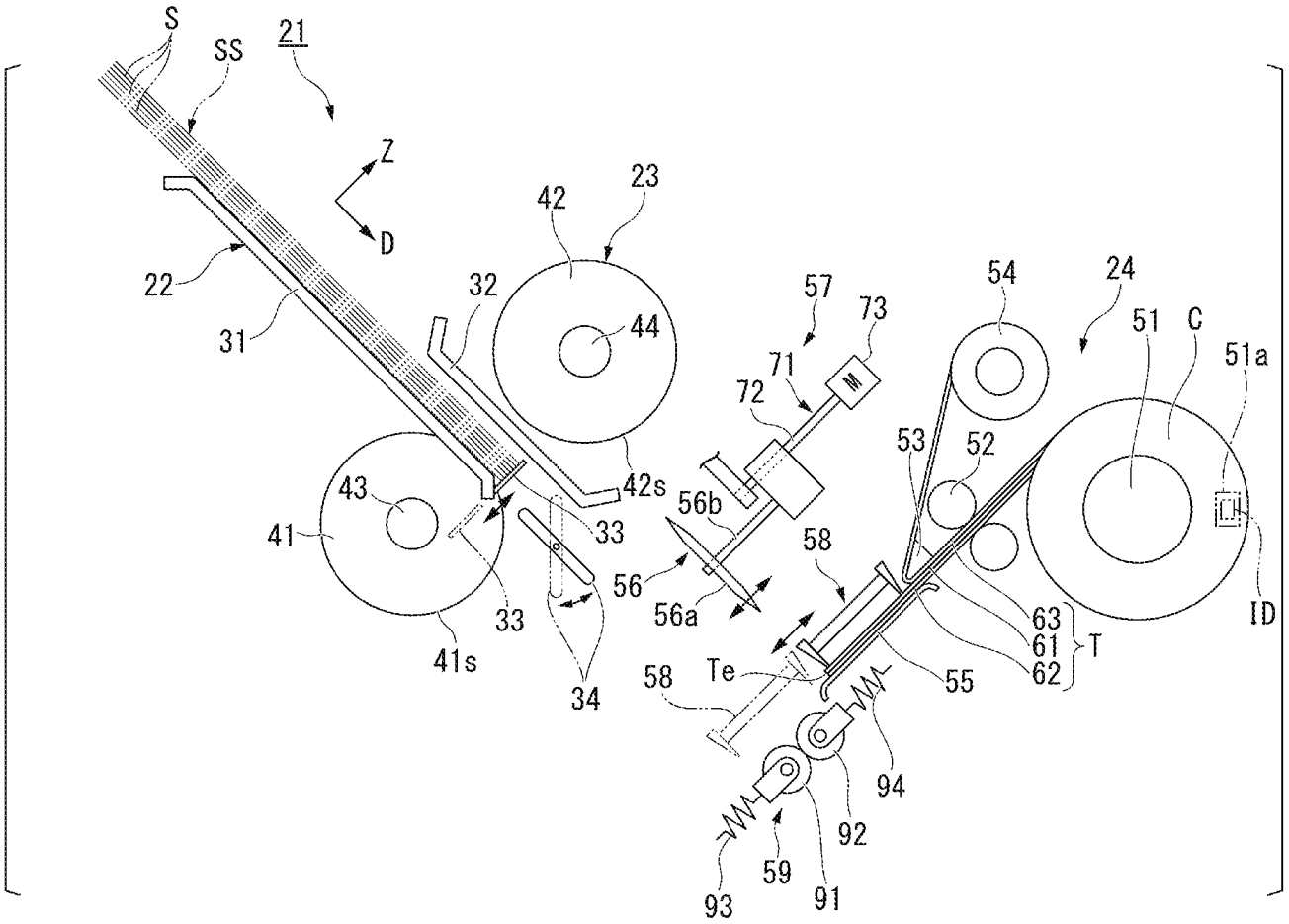
FIG. 3 is a front view of a configuration of a post-processing device according to an embodiment.

For example, the control panel 11 receives a user's input to bind a bundle of sheets SS using tape, and thus use a tape binding processing unit 24 as a sheet binding mechanism in the post-processing device 3. Specifically, the control panel 11 receives the user's input regarding at least one of information on the sheet S, information on a tape T, and information on a way to bind the sheets SS by the tape T. The tape T as shown in FIG. 3 is a binding tape for binding the sheets SS and is an adhesive tape including an adhesive layer 61.

For example, the control panel 11 receives a user input selecting a thickness of the sheet(s) S, a type of sheet S, and the number of sheets S to be bound by the tape T or the like as the "information on the sheet S". The "thickness of sheet S" is, for example, information indicating a thickness of a single sheet of the sheets S forming the bundle of sheets SS. The "type of sheet S" is, for example, information indicating quality of material of the sheets S forming the bundle of sheets SS or a type of sheet S classified by surface finish or the like for the sheet S. The "number of binding sheets S" is, for example, information indicating the number of sheets S forming a single bundle of sheets SS to be bound together by the tape T.

For example, the control panel 11 receives a user input selecting a type of tape T or the like as the "information on tape T". The "type of tape T" is information indicating the type of tape T classified by at least one of adhesiveness of tape T, the thickness of tape T, and elasticity of tape T. The information on the type of tape T, as will be described later, may be acquired by a tape information acquisition unit 51*a* (see FIG. 3) provided in the tape binding processing unit 24.

For example, the control panel 11 receives a user input to select an application position of tape T to the bundle of sheets SS, the number of staying tapes T to be applied to the bundle of sheets SS, a width of tape T along one side edge of the bundle of sheets SS, or the like as the "information on the way to bind the bundle of sheets SS by the tape T". The "staying position of tape T to the bundle of sheets SS" is information indicating which position (s) on the one side edge of the bundle of sheets SS is to be bound with the tape T. The "number of staying tapes T to be applied to the bundle of sheets SS" is information indicating how many sheets SS are to be bound together with the tape T as a bundle. The "width of tape T along one side edge of the bundle of sheets SS" is information indicating a width of tape T when the width of tape T is selectable.

For example, the control panel 11 receives a user input selecting the binding strength of the tape T applied to the bundle of sheets SS as the "information on the way to bind the bundle of sheets SS by the tape T". The "binding strength of the bundle of sheets SS by the tape T" is, for example, information indicating the degree of binding desired by a user. The "binding strength of the bundle of sheets SS by the tape T" is, for example, information indicating that the degree of binding selected for the bundle of sheets SS is either of "binding (strong adhesion mode)" or "temporary fixing (weak adhesion mode)". In the "binding" mode, the bundle of sheets SS are comparatively firmly bound together by the tape T, for example, as would be the case if the binding was made by a stapler. In the "temporary fixing" mode, for example, the bundle of sheets SS is comparatively loosely bound by the tape T such that the bundle of sheets SS is easily disassembled.

The scanner unit 12 includes a reading unit, to read the image information of an object to be copied. The scanner unit 12 transmits the read image information to the printer unit 13.

The printer unit 13 forms an output image (in the following, referred to as a "toner image") by a developer such as a toner based on the image information transmitted from the scanner unit 12 or an external device. The printer unit 13 transfers a toner image onto a surface of the sheet S. The printer unit 13 applies heat and pressure to the toner image transferred onto the sheet S to fix the toner image onto the sheet S.

The paper feeding unit 14 supplies the sheets S one by one to the printer unit 13 in accordance with a desired timing for when the printer unit 13 forms the toner image.

The paper discharge unit 15 conveys the sheet S discharged from the printer unit 13 to the post-processing device 3.

The image forming control unit 16 controls the entire operation of the image forming apparatus 2. That is, the image forming control unit 16 controls the control panel 11, the scanner unit 12, the printer unit 13, the paper feeding unit 14, and the paper discharge unit 15. The image forming control unit 16 is formed by a control circuit including a central processing unit (CPU), a read only memory (ROM), and a random access memory (RAM).

Next, the post-processing device 3 will be described.

First, the overall configuration of the post-processing device 3 will be described. As illustrated in FIG. 1, the post-processing device 3 is disposed to be adjacent to the image forming apparatus 2. The post-processing device 3 executes post-processing processes as designated through the control panel 11 on the sheet S conveyed from the image forming apparatus 2. For example, the post-processing to be executed can include sheet binding processing, sort processing, or the like.

In the embodiment, the post-processing device 3 is provided as a separate body different from the image forming apparatus 2 disposed adjacent to the image forming apparatus 2 to be directly fed sheets S therefrom. The post-processing device 3 performs post-processing processes as commanded thereto by through the control panel 11, on the sheet S conveyed from the image forming apparatus 2. For example, the post-processing may include sort processing, tape binding processing, or the like. For example, the post-processing device 3 may be a device disposed on a desk or a floor surface and independently used. For example, the post-processing device 3 may be built into and integrated with the image forming apparatus 2.

FIG. 3 illustrates a configuration of main parts of the post-processing device 3 according to an embodiment.

As illustrated in FIG. 2 and FIG. 3, the post-processing device 3 includes a processing unit 21, a paper discharge unit 25, and a post-processing control unit (control unit) 26.

The processing unit 21 performs specified post-processing on the conveyed sheet S. The processing unit 21 includes a bundle preparing unit 22, a sheet shifting unit 23, and a tape binding processing unit 24.

The bundle preparing unit 22 stacks a plurality of sheets S on each other to form the bundle of sheets SS.

Figure 5:
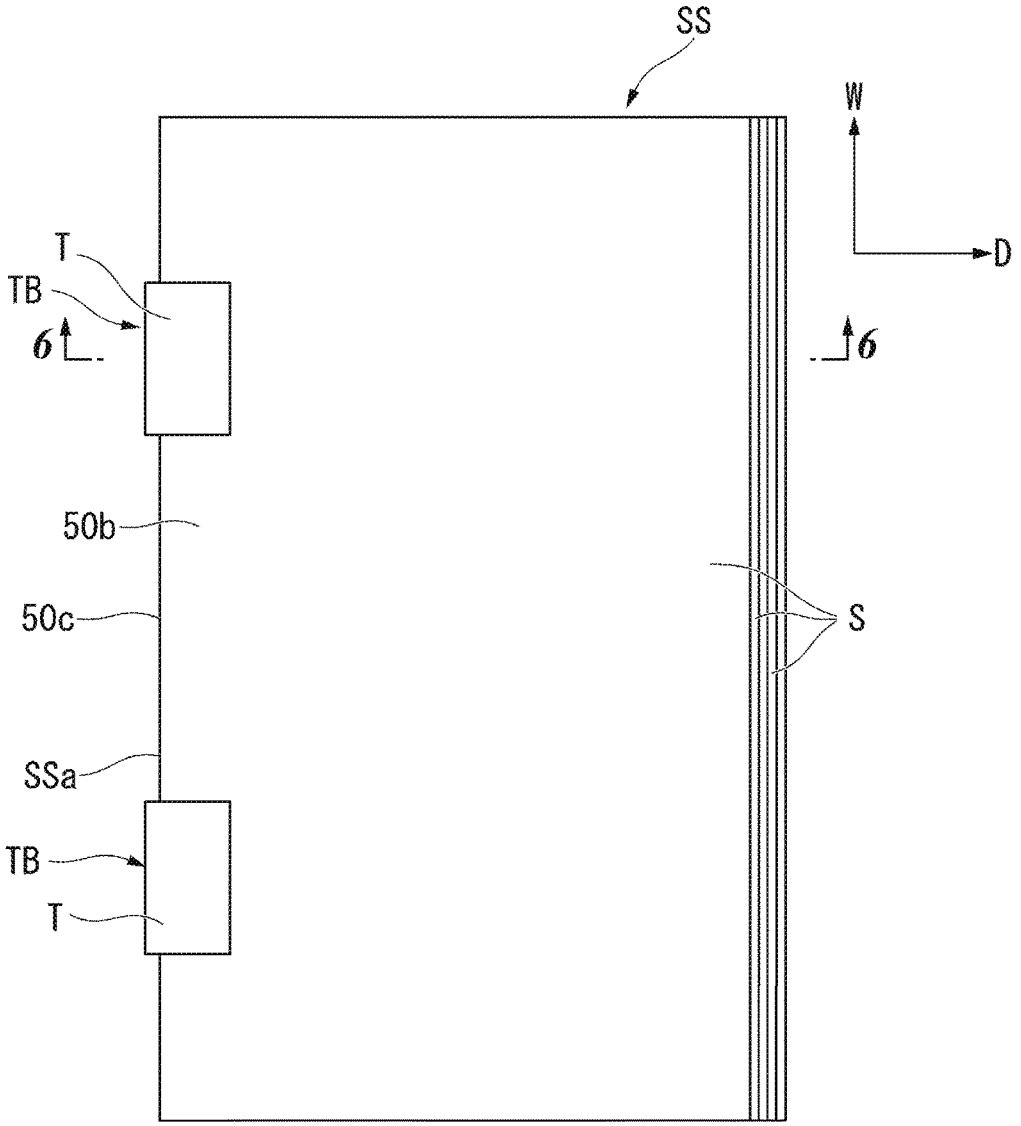
FIG. 5 is a plan view illustrating a tape bound bundle of sheets according to an embodiment.
Figure 6:
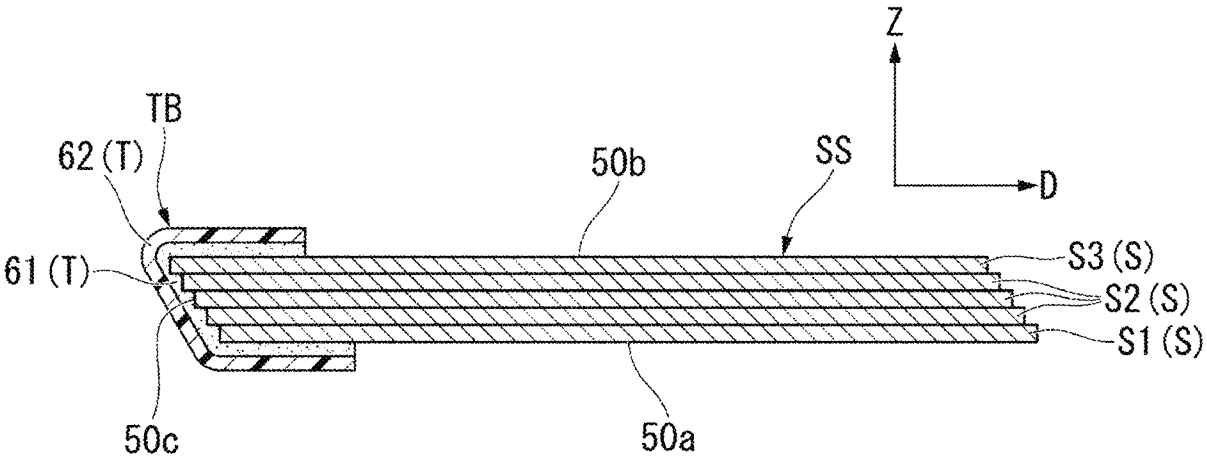
FIG. 6 is a sectional view of the tape bound bundle of sheets of FIG. 5 taken along line 6-6.

The sheet shifting unit 23 generates a state where a plurality of sheets S forming the bundle of sheets of sheets SS are successively shifted in a sheet conveyance direction D (see FIG. 5 and FIG. 6). The sheet conveyance direction D is included in a direction along front and rear surfaces of the bundle of sheets SS (in the following, referred to as the sheet surface direction). In the following, a direction orthogonal to the sheet conveyance direction D in the sheet surface direction is referred to as a sheet width direction W and a direction perpendicular to the sheet surface direction is referred to as a sheet thickness direction Z. The sheet S has a rectangular shape in plan view and in the embodiment, a short side direction of the sheet S coincides with the sheet conveyance direction D and a long side direction of the sheet S coincides with the sheet width direction W.

The sheet shifting unit 23 (FIG. 4) generates a state where a plurality of sheets S are shifted along their edge portions to form a step shape on both sides of the sheet conveyance direction D of the bundle of sheets SS. In the following, an edge portion of the upstream side of the sheet conveyance direction D in the bundle of sheets SS is referred to as one side edge SSa (FIG. 5).

The tape binding processing unit 24 binds the one side edge SSa of the bundle of sheets SS passed through the sheet shifting unit 23 with the tape T and forms the bundle of sheets SS subjected to the tape binding processing which integrally adheres together a plurality of sheets S.

The post-processing control unit 26 controls operations of the entirety of the image forming apparatus 2. The post-processing control unit 26 controls operations of the bundle preparing unit 22, the sheet shifting unit 23, and the tape binding processing unit 24 of the processing unit 21 and an operation of the paper discharge unit 25. The post-processing control unit 26 is formed of a control circuit including a CPU, a ROM, and a RAM similar to the image forming control unit 16.

FIG. 5 and FIG. 6 show a bundle of sheets SS after being subjected to the tape binding processing.

As illustrated in FIG. 5 and FIG. 6, the plurality of sheets S forming the bundle of sheets SS include a first sheet S1, a second sheet S2, and a plurality of third sheets S3.

The first sheet S1 is positioned on the lower most surface of the bundle of sheets SS and forms a cover sheet of for the bundle of sheets SS. The first sheet S1 is a sheet S conveyed to the processing unit 21 firstly in the bundle of sheets SS.

The third sheet S3 is positioned on the upper most (or back) surface on the bundle of sheets SS and forms a back cover sheet of the bundle of sheets SS. The third sheet S3 is a sheet S conveyed to the processing unit 21 lastly in the bundle of sheets SS.

The second sheet S2 is positioned between the first sheet S1 and the third sheet S3 and forms an intermediate-page sheet of the bundle of sheets SS. The second sheet S2 may be a single sheet or a plurality of sheets. The bundle of sheets SS may be formed by only the first sheet S1 and the third sheet S3 without the second sheet S2.

In the tape T, an adhesive layer 61 is integrally formed on one surface of base material (protective film 62). An end edge of the adhesive layer 61 faces the outer peripheral edge of the tape T.

The bundle of sheets SS includes a front surface 50*a*, a back surface 50*b*, and a side portion 50*c*. The front surface 50*a* is formed by the first sheet S1. The back surface 50*b* is formed by the third sheet S3. The side portion 50*c* is the outer peripheral edge of the bundle of sheets SS and is formed by side edges of a plurality of sheets S between the front surface 50*a* and the back surface 50*b*. The side portion 50*c* is formed by side edges of the first sheet S1, the second sheet(s) S2, and the third sheet S3. When the second sheet S2 does not exist, the side portion 50*c* is formed with only side edges of the first sheet S1 and the third sheet S3.

The bundle of sheets SS is formed by shifting a plurality of sheets S bit by bit in the sheet conveyance direction D in the stack of sheets S forming the bundle of sheets SS. The side portion 50*c* of both sides of the sheet conveyance direction D in the bundle of sheets SS is formed in a step shape by side edges of a plurality of sheets S and surfaces exposed through shifting of respective sheets S in the second sheet S2. When shifting of the plurality of sheets S is small, the portion of the main surface of the second sheet S2 and an adhesion area thereof with the tape T is small. When the plurality of sheets S are aligned to be stacked, i.e., when the side edge surfaces of adjacent sheets S are aligned, a portion of the main surface of the second sheet S2 is not exposed and only the side edge becomes the adhesion area with the tape T in the second sheet S2. In this case, the strength of the binding by the tape T to the sheets S2 is the weakest. On the other hand, when the shifting of the plurality of sheets S is large, the exposure area of the main surfaces is greater in the second sheet(s) S2 and an adhesion area between the tape T and the sheet S is larger on the second sheet(s) S2. In this case, the strength of the binding by the tape T becomes the strongest. That is, an amount of the of the plurality of sheets S may be changed to increase or decrease the sheet S surface area contacting the adhesive layer 61 of the tape T in the bundle of sheets SS to adjust the strength of the binding by the tape T. Although the amount of the shift of each of the plurality of sheets S is preferably substantially uniform, the amounts of shift of different ones of the plurality of sheets S may be non-uniform.

In the embodiment, the delivery direction of a strip-like tape T is arranged to be orthogonal to the one side edge SSa of the bundle of sheets SS as shown in FIG. 3. On the one side edge SSa of the bundle of sheets SS, the front surface 50*a*, the back surface 50*b*, and the side portion 50*c* of the bundle of sheets SS are made to stay together (be bound) by the tape T. That is, the adhesive layer 61 of the tape T is adhered to each of the front surface 50*a*, the back surface 50*b*, and the side portions 50*c* of the bundle of sheets SS. With this, the one side edge SSa of the bundle of sheets SS is bound and wrapped in three directions by the tape T. In the following, a portion bound by the tape T along the one side edge SSa of the bundle of sheets SS is referred to as a tape binding portion TB (FIG. 5).

As illustrated in FIG. 3, the bundle preparing unit 22 includes a main guide 31, a subguide 32, a moveable stop 33, and a switching member 34.

The main guide 31 guides the sheet S along the sheet surface direction. The plurality of sheets S are stacked on the main guide 31 in order to form the bundle of sheets SS.

The subguide 32 faces the main guide 31 in the sheet thickness direction Z. A space in which the bundle of sheets SS is disposed is provided between the main guide 31 and the subguide 32.

The stopper 33 is provided in the downstream side end portion of the main guide 31 in the sheet conveyance direction D. The stop 33 is movable between a regulating position (indicated by the solid line in FIG. 3) and a releasing position (indicated by the two-dot chain line in FIG. 3). The stop 33 may block the sheet(s) S in the regulating position and thereby form a bundle of sheets SS on the main guide 31. The stop 33 when properly positioned releases the sheets S in the releasing position and allows the bundle of sheets SS on the main guide 31 to pass toward the switching member 34.

The switching member 34 switches the bundle of sheets SS between different conveyance passage direction. In the following, a direction in which the bundle of sheets SS is conveyed toward the tape binding processing unit 24 is referred to as a "first conveyance direction". A direction in which the bundle of sheets SS is conveyed toward a position (for example, below the bundle preparing unit 22) different from the tape attaching portion 59 is referred to as a "second conveyance direction". The switching member 34 switches the conveyance direction of the bundle of sheets SS between the first conveyance direction and the second conveyance direction. The switching member 34 is rotatable between a first conveyance position (indicated by the solid line in FIG. 3) to guide the bundle of sheets SS in the first conveyance direction and a second conveyance position (indicated by the dashed line in FIG. 3) to guide the bundle of sheets SS in the second conveyance direction.

The sheet shifting unit 23 includes a first roller 41 and a second roller 42.

The first roller 41 is attached to a first shaft 43. The first roller 41 is a driving roller driven by a motor (not illustrated). The axial center (axis of rotation) of the first roller 41 is fixed. Materials of the first roller 41 are not particularly limited. For example, the first roller 41 is formed of ethylene propylene diene rubber (EPDM).

The second roller 42 is attached to a second shaft 44. For example, the second roller 42 is a driven roller which rotates as a result of rotation of the first roller 41. The second roller 42 is movable in directions approaching the first roller 41 or moving away from the first roller 41 by an axial center moving mechanism (not illustrated). The second roller 42 is moved toward the first roller 41 to contact the bundle of sheets SS therebetween from the side of the bundle of sheets SS opposite to the first roller 41.

Figure 4:
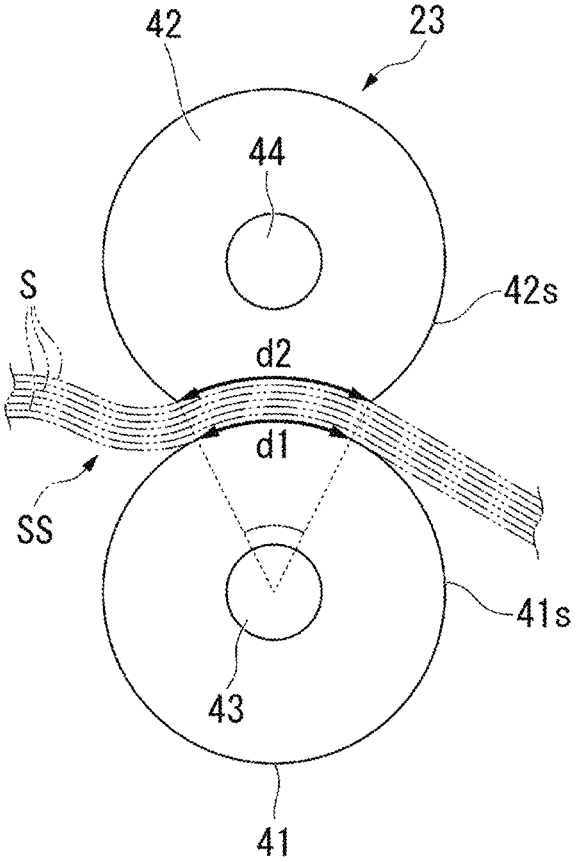
FIG. 4 is an explanatory diagram illustrating a principle of shifting of a plurality of sheets by the post-processing device according to the embodiment.

The outer peripheral surface 42*s* of the second roller 42 is softer, i.e., more compliant, than the outer peripheral surface 41*s* of the first roller 41 and is deformable along the front surface of the bundle of sheets SS (see FIG. 4). For example, the second roller 42 is formed by sponge or rubber within which a cavity is formed. When the second roller 42 approaches the first roller 41, the outer peripheral surface 42*s* of the second roller 42 and the bundle of sheets SS are deformed into a circular arc shape along the outer peripheral surface 41*s* of the first roller 41 extending toward the center of the second roller 42.

FIG. 4 illustrates a principle of shifting of a plurality of sheets S of the bundle of sheets SS.

As illustrated in FIG. 4, when the second roller 42 is pressure-contacted with the first roller 41 through the bundle of sheets SS, the outer peripheral surface 42*s* of the second roller 42 is deformed inwardly in the pattern of the outer peripheral surface 41*s* of the first roller 41. Along the outer peripheral surface 41*s* of the first roller 41, a circumferential length (arc length) of a portion contacting the bundle of sheets SS is referred to as a "first length d1". Along the outer peripheral surface 42*s* of the second roller 42, a length of a portion (recessed portion) contacting the bundle of sheets SS in a direction along a circumferential direction of the first roller 41 is referred to as a "second length d2".

The second length d2 is longer than the first length d1. In this state, the first roller 41 and the second roller 42 are rotated to convey out the bundle of sheets SS to the sheet conveyance direction D. In this case, the moving distance of the sheet S contacting the outer peripheral surface 42*s* of the second roller 42 is longer than that of the sheet S contacting the outer peripheral surface 41*s* of the first roller 41. That is, the conveyed distance of the sheets of the bundle of sheets SS becomes greater in the sheet conveyance direction D as the sheets of the bundle of sheets SS are closer to the second roller 42. As a result, a state where a plurality of sheets S are shifted in a step shape is formed on the one side edge SSa of the bundle of sheets SS.

As illustrated in FIG. 3, the tape binding processing unit 24 includes an unwinding unit 51, a tape conveyance unit 52, a separation member 53, a winding unit 54, a guide table 55, a cutter 56, a cut length changing unit 57, a tape holding unit 58, and a tape attaching portion 59.

For example, the unwinding unit 51 holds a raw web roll wound with the strip-like tape T. The unwinding unit 51 supplies the tape T delivered from the raw web roll along the delivery direction (length direction) of the tape T. When in the state held in the unwinding unit 51, the tape T contains a peelable film 63 in addition to the adhesive layer 61 and the protective film (base material) 62. The protective film 62 covers one side surface of the adhesive layer 61. The protective film 62 is used integrally with the adhesive layer 61. The peelable film 63 covers the other side surface of the adhesive layer 61 from a side opposite to the protective film 62. The peelable film 63 is peeled off from the adhesive layer 61 prior to use of the tape T. The peelable film 63 is pulled away from the adhesive layer 61 at the separation member 53 and the winding unit 54.

For convenience of explanation, a film to be peeled off and thereby expose the adhesive surface when the tape T is used is referred to as a "peelable film". On the other hand, a film for also protecting the adhesive layer 61 in a use state of the tape T is referred to as a "protective film". These names of "peelable film" and "protective film" are given for convenience's sake in order to distinguish both and may be referred to as different names.

For example, the tape T is attached to the unwinding unit 51 in a state of being accommodated in a cartridge C. For example, the cartridge C includes an identification portion ID indicating a type of tape T. The identification portion ID may include an IC chip, a barcode, a block pattern, or the like.

The tape binding processing unit 24 may include a tape information acquisition unit 51*a*. For example, the tape information acquisition unit 51*a* reads information from the identification portion ID of the cartridge C to acquire information on the type of tape T. The tape information acquisition unit 51*a* may include a sensor, a microswitch, or the like. The tape information acquisition unit 51*a* sends the acquired information on the type of tape T to the post-processing control unit 26. The post-processing control unit 26 controls the operation of the tape binding processing unit 24 based on information sent from the tape information acquisition unit 51*a*.

The tape conveyance unit 52 conveys the tape T supplied from the unwinding unit 51 along the length direction of the tape T. For example, the conveyance direction of the tape conveyance unit 52 is a direction substantially parallel to the sheet thickness direction Z. The guide table 55 guides the tape T separated from the peelable film 63. The guide table 55 supports the tape T when holding or cutting the tape T.

The cutter 56 cuts out the strip-like tape T supplied from the unwinding unit 51 to form a sheet-like tape T. For example, the cutter 56 is a rotary cutter which includes a cutting blade 56*a* and a supporting shaft 56*b*. The cutting blade 56*a* is rotationally driven along with the supporting shaft 56*b* by a motor {not illustrated). A configuration of the cutter 56 is not limited to the example described above. The cutter 56 is movable in directions approaching the tape T or moving away from the tape T by a moving mechanism (not illustrated).

The cut length changing unit 57 position determines the delivery length of the tape T cut out by the cutter 56. The delivery length of the tape T is sufficient for wrapping around a portion spanning from the front surface 50*a* to the back surface 50*b* across the side portion 50*c* of the one side edge SSa of the bundle of sheets SS in three directions. The cut length changing unit 57 includes a moving mechanism 71 for changing a relative position of the cutter 56 with respect to a tip end Te of the tape T supplied from the unwinding unit 51. For example, the moving mechanism 71 moves the cutter 56 to change the relative position of the cutter 56 with respect to the tip end Te of the tape T. For example, the moving mechanism 71 moves the cutter 56 along the conveyance direction of the tape conveyance unit 52.

The moving mechanism 71 includes a supporting member 72 supporting the cutter 56 and a driving source 73 moving the cutter 56 along the supporting member 72. For example, the supporting member 72 is a lead screw connected to the cutter 56. The driving source 73 is a motor which drives the lead screw to move the cutter 56. A configuration of the moving mechanism 71 is not limited to the example described above. For example, the moving mechanism 71 may change the delivery length of the tape T with respect to the cutter 56 fixed in place and may also change the relative position of the cutter 56 with respect to the tip end Te of the tape T.

The cut length changing unit 57 is controlled by the post-processing control unit 26. For example, the post-processing control unit 26 controls the driving source 73 of the cut length changing unit 57 to move the cutter 56 and changes the length of the tape T cut out by the cutter 56. For example, the cut length changing unit 57 changes the length of the tape T cut out by the cutter 56 based on information on the sheet S, information on the tape T, information on the way to bind the bundle of sheets SS and the like.

The tape holding unit 58 supports the tape T in a state of holding a posture of the tape T substantially flat, with the adhesive side of the tape T facing the one side edge SSa of the bundle of sheets SS. The tape holding unit 58 is movable along the length direction of the tape T by a moving mechanism not illustrated. The tape holding unit 58 is movable in directions approaching the tape T or moving away from the tape T by a moving mechanism not illustrated.

The tape attaching portion 59 includes a first urging roller 91, a second urging roller 92, a first spring 93, and a second spring 94. The first spring 93 urges the first urging roller 91 toward the second urging roller 92. The second spring 94 urges the second urging roller 92 toward the first urging roller 91. The one side edge SSa of the bundle of sheets SS, and the tape T, are inserted between the first urging roller 91 and the second urging roller 92 when the tape T is attached to the one side edge SSa. With this, the tape T is engaged against the one side edge SSa and begins to be folded such that the one side edge SSa of the bundle of sheets SS is wrapped by the tape attaching portion 59 and the tape T is attached to one side edge SSa of the bundle of sheets SS and over the main surfaces of the first and third sheets S1, S3.

Next, operations of the post-processing device 3 will be schematically described.

First, the bundle preparing unit 22 moves the stop 33 to the regulating position to block the sheet S conveyed along the main guide in the main guide 31. With this, a plurality of sheets S are stacked in order on the main guide 31 to form a bundle of sheets SS.

After the bundle of sheets SS is formed, the bundle preparing unit 22 moves the stop 33 to the releasing position and switches the switching member 34 to the second conveyance position. With this, the bundle of sheets SS is guided to the sheet shifting unit 23.

The sheet shifting unit 23 moves the second roller 42 toward the first roller 41. With this, the bundle of sheets SS and the outer peripheral surface 42*s* of the second roller 42 are deformed into a circular arc shape along the outer peripheral surface 41*s* of the first roller 41.

The sheet shifting unit 23 determines a sheet shifting amount based on at least one of information on a plurality of sheets S, information on the tape T, information on the way to bind the bundle of sheets SS by the tape T and the like. For example, the sheet shifting unit 23 determines a rotation angle of the first roller 41 as a control amount. The sheet shifting unit 23 moves the first roller 41 forwardly based on the determined rotation angle of the second roller 42 in a state where the bundle of sheets SS is pinched between the first roller 41 and the second roller 42.

With this, the second roller 42 is rotated as a result of the rotation of the first roller 41 while maintaining a recessed state along the outer peripheral surface 41*s* of the first roller 41. As a result, the plurality of sheets S (the bundle of sheets SS) is in a state of where individual sheets are shifted in a step shape in the sheet conveyance direction D on the one side edge SSa of the bundle of sheets SS.

After shifting the plurality of sheets S, the sheet shifting unit 23 moves the second roller 42 in a direction separating it from the first roller 41. With this, the recess in the outer peripheral surface 42*s* of the second roller 42 is eliminated. The sheet shifting unit 23 rotates the first roller 41 and the second roller 42 reversely in a state where the recess of the outer peripheral surface 42*s* of the second roller 42 is eliminated. With this, the bundle of sheets SS is moved toward a reverse direction which is opposite to the sheet conveyance direction D. Thereafter, the switching member 34 is switched to the first conveyance position and the conveyance passage directing toward the second conveyance direction is directed toward the first conveyance direction. In this state, the first roller 41 and the second roller 42 are rotated forwardly to move the bundle of sheets SS toward the tape binding processing unit 24.

The tape binding processing unit 24 sets a length of the tape T cut out by the cutter 56 by control of the post-processing control unit 26. The tape binding processing unit 24 moves the tape holding unit 58 to a location between one side edge SSa of the bundle of sheets SS and the tape attaching portion (indicated by two-dot chain line in FIG. 3) while holding the tape T in the tape holding unit 58. The tape binding processing unit 24 cuts out the strip-like tape T with the cutter 56 to form a tape T having a sheet-like length.

Thereafter, for example, the first roller 41 and the second roller 42 are rotated forwardly to move the one side edge SSa of the bundle of sheets SS toward the tape attaching portion 59. With this, one side edge SSa of the bundle of sheets SS abuts against the tape T and the one side edge SSa of the bundle of sheets SS and the tape T are inserted between the first urging roller 91 and the second urging roller 92.

When the one side edge SSa of the bundle of sheets SS and the tape T are inserted between the first urging roller 91 and the second urging roller 92, the first urging roller 91 and the second urging roller 92 each move along an outer, opposed, main surface of the first and third sheets S1, S3 adjacent to the one side edge SSa of the bundle of sheets SS. With this, the first urging roller 91 and the second urging roller 92 push against the tape and thus hold it as the one side edge SSa of the bundle of sheets SS is pushed against it. As a result, the tape T tightly contacts the step shaped side portion 50*c* of the one side edge SSa of the bundle of sheets SS by sequentially following the step shaped side portion 50*c* and also tightly contacts the front surface 50*a* and the back surface 50*b* of the front and back sheets S adjacent to the one side edge SSa of the bundle of sheets SS. With this, all sheets S containing an intermediate-page of the bundle of sheets SS are integrally bound by the tape T.

Thereafter, the first roller 41 and the second roller 42 are rotated in reverse to extract the one side edge SSa of the bundle of sheets SS from between the first urging roller 91 and the second urging roller 92. The first roller 41 and the second roller 42 are rotated in reverse such that the bundle of sheets SS is discharged to a paper discharge tray 25*a* of the paper discharge unit 25.

Configurations of the bundle preparing unit 22, the sheet shifting unit 23, and the tape binding processing unit 24 are just examples and those configurations are not limited to the examples described above.

For example, the tape binding processing unit 24 is movable in the sheet width direction W by a movement unit including a guide rail which extends in the sheet width direction W. The tape binding processing unit 24 may perform the tape binding processing on the bundle of sheets SS in an arbitrary position in the sheet width direction W. A configuration of the tape binding processing unit 24 is not limited to a configuration in which the tape binding processing unit 24 moves in the sheet width direction W and the tape binding processing unit 24 may be configured in such a way that a side (bundle preparing unit 22 and sheet shifting unit 23) holding the bundle of sheets SS moves in the sheet width direction W. A configuration, in which the tape binding processing unit 24 or the like is movable in the sheet conveyance direction D and the tape binding processing may be performed on the bundle of sheets SS in an arbitrary position in the sheet conveyance direction D, may be adopted.

Figure 7:
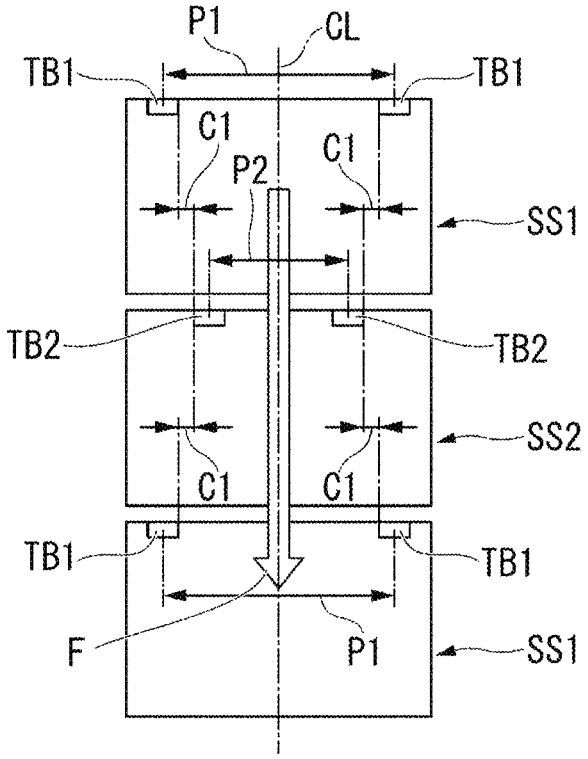
FIG. 7 is a plan view illustrating bundles of sheets discharged to a paper discharge tray according to the embodiment arranged in order of discharge.

FIG. 7 is a plan view illustrating the bundle of sheets SS discharged to the paper discharge tray 25*a* arranged in order of discharge.

As illustrated in FIG. 7, in the embodiment, the first bundle of sheets SS1 and the second bundle of sheets SS2 of which positions of the tape binding portions TB are different from each other are alternately discharged. The arrow F in FIG. 7 indicates a paper discharging direction. A first bundle of sheets SS1 which have been bound by tape T and a second bundle of sheets SS2 that have been bound by tape T are stacked on each other on the paper discharge tray 25*a* in a contact state. The first bundle of sheets SS1 includes three first tape binding portions TB1, which are spaced along one side edge SSa, on the one side edge SSa in the sheet conveyance direction D. The second bundle of sheets SS2 includes a pair of second tape binding portions TB2, which are spaced apart along the one side edge SSa.

In the paper discharge tray 25*a*, the first bundle of sheets SS1 and the second bundle of sheets SS2 are stacked on each other in a state the outer profile or perimeter of the bundles of sheets SS1 and SS2 are substantially aligned with each other. In this case, a pair of first tape binding portions TB1 binding the first bundle of sheets SS1 and a second pair of second tape binding portions TB2 binding the second bundle of sheets SS2 are shifted with respect to each other in the sheet width direction W. The first tape binding portion TB1 and the second tape binding portion TB2, which are present on the same side of the bundles, such as the one side portion SSa, are shifted in the sheet width direction W by a distance C1 from each other such that they are not stacked on each other in the sheet width direction W. The distance C1 may be the same or different in respective binding portions.

That is, in the first bundle of sheets SS1 and the second bundle of sheets SS2 stacked on each other, the first tape binding portion TB1 and the second tape binding portion TB2 are spaced from each other in the sheet width direction W. As a result, an increase in the stacking thickness on the perimeter of the bundles of sheets SS where the tape binding portion TB of the first bundle of sheets SS1 and the second bundle of sheets SS2 are present is reduced. The mutual contact of the tapes T between the first bundle of sheets SS1 and the second bundle of sheets SS2 is prevented.

In the example in FIG. 7, the spacing P1 between one pair of first tape binding portions TB1 and the spacing P2 between one pair of second tape binding portions TB2 are different from each other. The sheet binding portions of one pair of first tape binding portions TB1 and the sheet binding portions of one pair of second tape binding portions TB2 are equally spaced from each other to either side of the center (indicated by line CL) of the sheet width direction W of the bundle of sheets SS which they bind. With this, the tape binding positions are not offset in the sheet width direction W about the center CL of the sheets and the first bundle of sheets SS1 and the second bundle of sheets SS2 may be respectively bound with good balance about the center CL.

Figure 10:
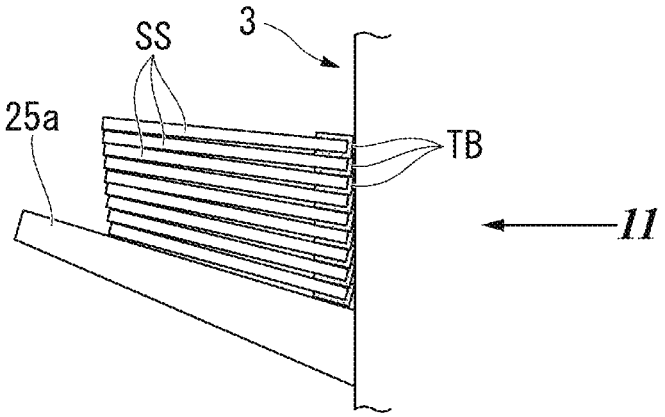
FIG. 10 is a front view illustrating a piled-up state of bundle of sheets discharged in a paper discharge tray of the embodiment.
Figure 11:
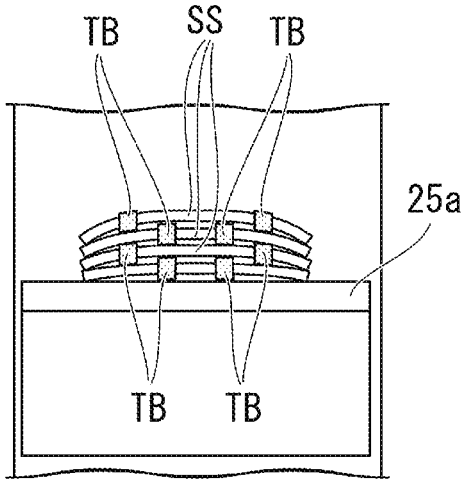
FIG. 11 is a diagram viewing from the direction of arrow of 11 in FIG. 10.

FIG. 10 and FIG. 11 illustrate a stack of a plurality of bundle of sheets SS discharged in the paper discharge tray 25*a*.

A plurality of bundles of sheets SS on the paper discharge tray 25*a* respectively include tape binding portions TB in the one side edge SSa on the upstream side of each bundle in the sheet conveyance direction D. A stack height the plurality of bundles of sheets SS stacked on the paper discharge tray 25*a* is partially increased due to the thickness of the tape binding portion TB (tape T). However, in the embodiment, respective tape binding portions TB of the bundles of sheets SS stacked on each other are shifted to be spaced from each other in the sheet width direction W. With this, the location of the thickness of the tapes T do not overlap one another on each adjacent bundle and the tape binding portions TB of each bundle of sheets SS are not stacked on each other.

Figure 12:
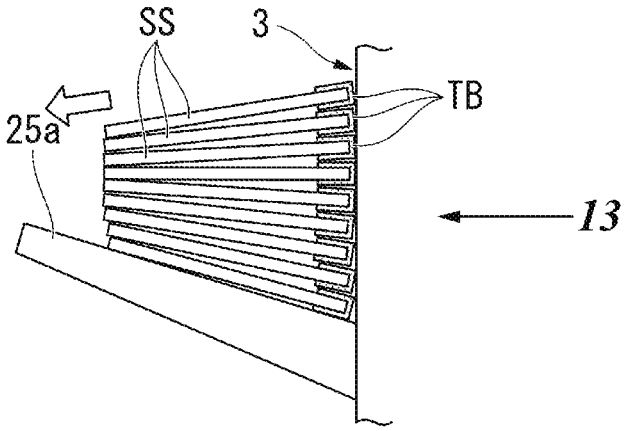
FIG. 12 is a side view corresponding to FIG. 10 in a comparative example.
Figure 13:
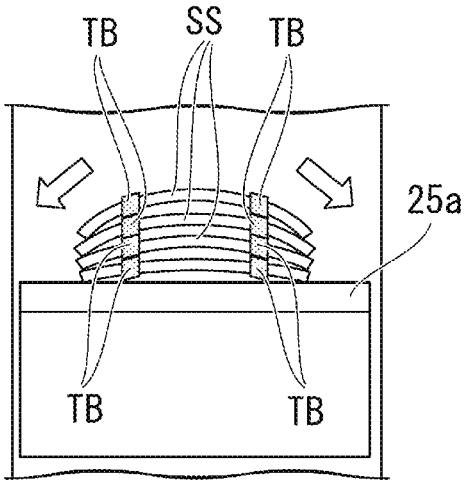
FIG. 13 is a diagram viewing from an arrow direction of 13 in FIG. 12.

FIG. 12 and FIG. 13 illustrate a stack of a plurality of bundles of sheets SS discharged to the paper discharge tray 25*a* in a comparative example.

In the comparative example, at least portions of respective tape binding portions TB of the bundles of sheets SS stacked on each other are also stacked over each other in the sheet width direction W. With this, at least portions of respective tape binding portions TB of each bundle of sheets SS are stacked on each other and the thickness of the tape T is duplicated (double the tape thickness added to the height added of the stack thickness) between the bundles of sheets SS stacked on each other. For that reason, compared to the embodiment, a stacking thickness is increased by the thicknesses of the tapes T between the bundles of sheets SS stacked on each other. Then, when a plurality of bundles of sheets SS are stacked up, the increase of the stack height at the sheets periphery where the tape binding portion is present is increased. As a result, the stacked bundles of sheets are significantly inclined with respect to the sheet conveyance direction D, and the stack is deformed into a large hill shape with respect to the sheet width direction W or the like, and thus the balance of the bound bundles of sheets SS becomes worse.

On the other hand, in the embodiment, respective tape binding portions TB of the bundles of sheets SS stacked on each other are shifted to be spaced from each other in the sheet width direction W, at least for each adjacent bound bundle of sheets. For that reason, the thickness of the tape T is not duplicated (double the tape thickness added to the height added of the stack thickness) between the bundles of sheets SS stacked on each other and the increase in the stack height at the one side edge SSa where the tape binding portions are present is reduced, as only the thickness of a sing tape binding portion is added to the thickness of the stack. Additionally, the adhesive layers 61 of the tapes T of each bundle of sheets SS are suppressed from being brought into contact with and adhered to each other in the stack of the bundles of sheets SS. For that reason, the bundles of sheets SS stacked on each other do not easily attach to each other through the tape T.

Figure 8:
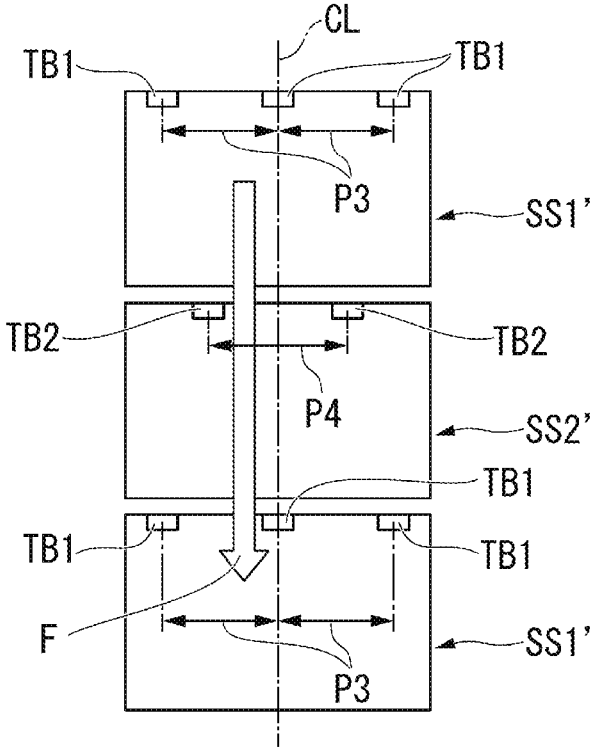
FIG. 8 is a plan view corresponding to FIG. 7 in a first modification example of the embodiment.

FIG. 8 is a plan view corresponding to FIG. 7 and illustrates a first modification example of the embodiment.

The first modification example differs from the example in FIG. 7 in the following points. In the first modification example, a first bundle of sheets SS1' and a second bundle of sheets SS2' having different quantities of tape binding portions TB are alternately discharged. The first bundle of sheets SS1' and the second bundle of sheets SS2' are stacked on each other in a contact state on the paper discharge tray 25*a*. The first bundle of sheets SS1' includes three first tape binding portions TB1 along the one side edge SSa, spaced apart in the sheet width direction W. The second bundle of sheets SS2' includes one pair of second tape binding portions TB2 along the one side edge SSa and spaced apart in the sheet width direction W. In the first bundle of sheets SS1', a single first tape binding portion TB1 is symmetrically disposed over the center CL of the sheet in the width direction W of the bundle of sheets SS and the other two first tape binding portions TB1 are symmetrically disposed on either side of the center CL of the sheet in the width direction W, i.e., they are spaced equidistant from the center CL on opposed sides of the first tape binding portion TB1. On the second bundle of sheets SS2', one pair of second tape binding portions TB2 is provided, one of each disposed to either side of, and equidistant from, the center CL of the sheet width. The spacing P3 between the three first tape binding portions TB1' and the spacing P4 between pair of second tape binding portions TB2' differ from each other, in particular the spacing of the second tape biding portions from the center of the sheet in the width direction is different than that of the other two first tape binding portions TB2, such that do not overlie each other in a stack thickness direction when stacked.

Figure 9:
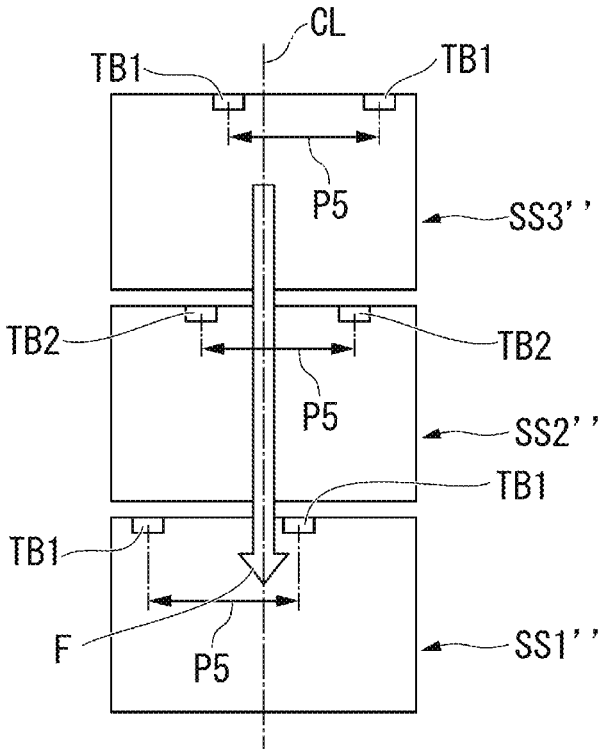
FIG. 9 is a plan view corresponding to FIG. 7 in a second modification example of the embodiment.

In the paper discharge tray 25*a*, the first bundle of sheets SS1' and the second bundle of sheets SS2' are stacked on each other in a state where the outer perimeters of the bundles of sheets SS1' and SS2' are substantially aligned with each other. In this case, three first tape binding portions TB1 of the first bundle of sheets SS1' and one pair of second tape binding portions TB2 of the second bundle of sheets SS2' are shifted from each other in the sheet width direction W. The locations of the respective first tape binding portions TB1 and respective second tape binding portions TB2 are shifted from each other in the sheet width direction W, and thus no second tape binding portion TB2 overlies a first tape binding portion TB1 in the sheet width direction W. FIG. 9 is a plan view corresponding to FIG. 7 and illustrates a second modification example of the embodiment.

The second modification example differs from the example in FIG. 7 in the following points. In the second modification example, the first bundle of sheets SS1", the second bundle of sheets SS2", and the third bundle of sheets SS3", in each of which one pair of tape binding portions TB are disposed at the same spacing, are discharged in that order.

The first bundle of sheets SS1" and the second bundle of sheets SS2" are stacked on each other in a contact state on the paper discharge tray 25*a*. The second bundle of sheets SS2" and the third bundle of sheets SS3" are stacked on each other in a contact state on the paper discharge tray 25*a*. The third bundle of sheets SS3" and another first bundle of sheets SS1" are stacked on each other in a contact state on the paper discharge tray 25*a*. The first bundle of sheets SS1" includes one pair of first tape binding portions TB1 extending over and spaced apart along the one side edge SSa, which tape binding portion TB1 are offset from being equally spaced from the center CL of the sheets to a first side of the sheet in the width direction W. The second bundle of sheets SS2" includes one pair of second tape binding portions TB2 extending over and spaced apart along the one side edge SSa, which are likewise are offset from being equally spaced from the center CL of the sheets to the first side of the sheets, but these second tape binding portions TB2 are offset less toward the first side edge than are the first tape binding portions TB1. The third bundle of sheets SS3" includes one pair of third tape binding portions TB3 over and spaced along the one side edge SSa, which are offset from being equally spaced from the centerline CL of the sheets to the other side of the sheet width direction W opposite from the first side.

The spacing (distance) P5 between the pair of first tape binding portions TB1, the pair of second tape binding portions TB2, and the pair of third tape binding portions TB3 is the substantially the same, and thus only the offset distance from the center of the sheets in the width direction W is different. That is, in each of the three bundles of sheets SS, each pair of tape binding portions TB is moved in the sheet width direction W, but the spacing therebetween is the same for all three pairs of tape binding portions TB1, TB2 and TB3.

In the example in FIG. 7, three bundles of sheets SS are shown. In them on each bindle of sheets, positions of one pair of tape binding portions TB are moved from one side toward the other side of the sheet width direction W from being centered on the centerline without changing the spacing between each other. In contrast, a configuration, in which two types of the bundle of sheets SS are set and positions of one pair of tape binding portions TB are alternately moved in the sheet width direction W without changing spacing between each other, may be adopted. As bundles of sheets SS are discharged from the post processing device 3 to the paper discharge tray 25*a*, the pattern of locations of the tape binding portions TB on the bundles is repeated, so, for example, where three different tape binding locations are used, a bundle of sheets having the first tape binding portion TB1 locations is next stacked over a bundle of sheets having the third tape binding portion TB3 locations, followed by a bundle of sheets with the second tape binding portion TB2 locations, then a bundle of sheets with the third tape bundle portion TB3 locations, and then another bundle of sheets with the first tape binding TB1 locations thereon, etc., are stacked. Additionally, a bundle of sheets SS having the third tape binding portion locations TB3 can be located over a bundle of sheets having the first tape binding portion TB1 locations, followed by a bundle with the first or the second tape binding portion TB1, TB2 locations, so long as no two adjacent bundles of sheets SS have the same tape binding locations such that they will contact each other in the stack thickness direction.

In the paper discharge tray 25*a*, the first bundle of sheets SS1", the second bundle of sheets SS2", and the third bundle of sheets SS3" are stacked on each other in a state where the sides of the bundles of sheets SS1", SS2" and SS3" are substantially aligned with each other. In this case, one pair of first tape binding portions TB1 of the first bundle of sheets SS1", one pair of second tape binding portions TB2 of the second bundle of sheets SS2", and one pair of third tape binding portions TB3 of the third bundle of sheets SS3" are shifted from each other in the sheet width direction W. Respective first tape binding portions TB1, respective second tape binding portions TB2, and respective third tape binding portions TB3 are shifted from each other in the sheet width direction W and thus are not stacked over each other. Respective first tape binding portions TB1, respective second tape binding portions TB2, and respective third tape binding portions TB3 are thus spaced from each other in the sheet width direction W.

For example, when three bundles of sheets SS are prepared, the post-processing control unit 26 sets tape binding positions for binding a first bundle of sheets SS. When a second bundle of sheets SS is prepared, the post-processing control unit 26 sets tape binding positions different from the tape binding positions of the first bundle of sheets SS. When a third bundle of sheets SS is prepared, if a position different from either of the tape binding position of the first and second bundles of sheets SS can be made, the post-processing control unit 26 sets that position as the tape binding position for the third bundle of sheets SS. When the third bundle of sheets SS is prepared, the post-processing control unit 26 may set the tape binding position of the third bundle of sheets SS at the same position as the tape binding position of the first bundle of sheets SS, as long as the tape binding position of the second bundle of sheets SS is avoided. Shift processing for the tape binding position may be automatically performed by the post-processing control unit 26 and may be turned on and off through a user' selecting operation. At least one of a position and the number of tape binding portions TB may be set based on the user' selecting operation.

The bundle of sheets SS, after going through the processing unit 21, is discharged to the paper discharge tray 25*a* of the paper discharge unit 25 (see FIG. 1).

Additionally, when a plurality of bundles of sheets SS are discharged, the paper discharge unit 25 may shift a discharging position of the bundles of sheets SS in the sheet width direction W each time when the bundle of sheets SS is discharged. For example, when a plurality of bundles of sheets SS are discharged, the paper discharge unit 25 may shift a position of the paper discharge tray 25*a* in the sheet width direction W each time a next bundle of sheets SS is discharged. With this, a plurality of bundles of sheets SS on the paper discharge tray 25*a* are stacked on each other in the sheet width direction W while each bundle of sheets is shifted in the width direction W from the adjacent bundles of sheets SS.

When the plurality of bundles of sheets SS are discharged, at least one pair of bundles of sheets SS (first bundle of sheets SS1 and second bundle of sheets SS2) are stacked on each other in a contact state on the paper discharge tray 25*a*. In this case, the first tape binding portion TB1 of the first bundle of sheets SS1 and the second tape binding portion TB2 of the second bundle of sheets SS2 are shifted from each other in the sheet width direction W by control of the paper discharge unit 25. With this, the first tape binding portions TB1 and the second tape binding portions TB2 may be spaced from each other about the center CL in the sheet width direction W without shifting the position of the tape binding portions TB with respect to two consecutive bundles of sheets SS.

In this case, each bundle of sheets SS having the same tape binding position may be prepared without changing a position and/or the number of tape binding portions TB in the bundle of sheets SS.

Additionally, when the plurality of bundles of sheets SS are discharged, the paper discharge unit 25 may shift the discharge position of the bundle of sheets SS in the sheet conveyance direction D each time a bundle of sheets SS is discharged. For example, when the plurality of bundles of sheets SS are discharged, the paper discharge unit 25 may shift a position of the paper discharge tray 25*a* in the sheet conveyance direction D each time when the bundle of sheets SS is discharged. With this, the plurality of bundles of sheets SS on the paper discharge tray 25*a* are stacked on each other while the one side edges SSa thereof are shifted in the sheet conveyance direction D on the discharge tray 25*a* for each adjacent bundle of sheets SS.

As such, the discharging position of the bundles of sheets SS may be shifted in the sheet conveyance direction D instead of shifting the discharging position of the bundle of sheets SS in the sheet width direction W. This is especially effective when the tape binding position of the bundle of sheets SS is present in one side of the sheet width direction W. That is, disposition of the tape binding portion TB according to the embodiment may be applied when binding an edge other than the one side edge of the bundle of sheets SS in the sheet width direction W. In this case, the tape binding portion TB is disposed in the "sheet conveyance direction D" by replacing the "sheet width direction W" of description with reference to FIG. 7 to FIG. 9 described above.

The post-processing control unit 26 controls at least one of the tape binding processing unit 24 and the paper discharge unit 25 and shifts the position of the tape binding portion TB of the bundle of sheets SS on the paper discharge tray 25*a*. Respective tape binding portions TB of one pair of bundles of sheets SS stacked on each other in a contact state are shifted from each other in the sheet surface direction by control of the post-processing control unit 26. The sheet surface direction includes the sheet width direction W and the sheet conveyance direction D. The sheet surface direction is orthogonal to the stacking direction (sheet thickness direction Z) of one pair of bundle of sheets SS. The shift amount of the tape binding portions TB is a distance with which at least the tape binding portions TB do not stack over each other (are separated) when viewed in the stacking direction Z of the bundle of sheets SS.

In the post-processing device 3 according to the embodiment, respective tape binding portions TB of a plurality of bundles of sheets SS stacked on each other in an abutting state in the paper discharge tray 25*a* are distributed in the sheet surface direction without the tape portions TB being stacked on each other. With this, compared to when respective tape binding portions TB of a plurality of bundles of sheets SS are stacked on each other, the increase in the stacking thickness in the periphery of the tape binding portions TB of the plurality of bundle of sheets SS is reduced. For that reason, the stacked height in the periphery of the tape binding portions TB of the plurality of piled up bundles of sheets SS is reduced. Accordingly, collapse of the stack of the plurality of bundles of sheets SS may be suppressed.

Respective tape binding portions TB of one pair of bundles of sheets SS stacked on each other in an abutting state are separated from each other in the sheet surface direction. With this, the tapes T of respective tape binding portions TB are prevented from contacting each other between the plurality of bundles of sheets SS stacked on each other in an abutting state. For that reason, a situation that the adhesive layers of respective tapes T are adhered to each other by being contacted with each other is avoided, and the result of the plurality of piled up bundles of sheets SS being stuck to each other by adhesion of the adhesive layers of respective tapes T may be avoided.

In the post-processing device 3 according to the embodiment, the post-processing control unit 26 controls the tape binding processing unit 24 and shifts the position of the tape binding portions TB for the bundle of sheets SS in the width direction of the side of the sheets to which the tape binding portion is applied. With this, respective tape binding portions TB of the plurality of bundles of sheets SS stacked on each other are spaced from each other in the sheet surface direction. When a plurality of sheet tape binding portions TB are formed in each bundle of sheets SS, the tape binding position is set such that all of the plurality of tape binding portions TB are spaced from each other.

In the post processing device 3, one, or a plurality of tape binding processing units 24 equal in number to the maximum number of individual tape bindings desired to be applied to a bundle of sheets SS, are provided. Where one tape bundling unit 24 is provided, the tape bundling unit is provided at a first location in the sheet width direction to apply a first tape binding to the bundle of sheets SS, and after the bundle of sheets having the first tape applied thereto is retracted from the tape bundling unit 24, the tape bundling unit 24 is moved in the width direction of the bundle of sheets W, and the tape applying process is repeated to apply a second tape binding to the bundle of sheets SS. This is repeated for the number of tape bindings to be applied to the specific bundle of sheets.

Where multiple tape binding units 24 are provided in the post processing device 3, each tape binding unit is moveable along a slide in a direction generally parallel to the edge of the sheets S to be bound, such as by a motor and lead screw device, or other positioning device. Where two tapes T are used to bind a bundle of sheets SS, two of the tape binding units 24, each holding a segment of binding tape, are simultaneously entered by the bundle of sheets, and the two tapes are simultaneously applied to the edge and adjacent sheet sides thereof. When three tapes T are used to bind a bundle of sheets SS, three of the tape binding units 24, each one holding a segment of binding tape, are simultaneously entered by the bundle of sheets, and the three tapes are applied to the edge and adjacent side surfaces thereof. Thus, for X number of tape bindings of a bundle of sheets SS, a number X of the tape binding units 24, each holding a segment of binding tape, are simultaneously entered by the bundle of sheets, and X tapes are is applied to the edge and adjacent side surfaces thereof, where X is a whole number greater than one.

According to this configuration, the tape binding portions TB may be distributed in the sheet surface direction by moving the tape binding portion TB location relative to the bundle of sheets SS. For that reason, the stacking height of the plurality of tape binding portions TB of each bundle of sheets SS is reduced after a plurality of bundles of sheets SS are stacked on each other in a state of being aligned along their bound edges or sides. The tape binding portions TB of each bundle of sheets SS are spaced from each other in the sheet surface direction after a plurality of bundle of sheets SS are stacked on each other in a state of being aligned along at least their bound edges or sides.

In the post-processing device 3 according to the embodiment, the post-processing control unit 26 sets the spacing P1 between a plurality of first tape binding portions TB1 and the spacing P2 between a plurality of second tape binding portions TB2 to be different from each other. The spacing P1 between the plurality of first tape binding portions TB1 is a spacing within a single first bundle of sheets SS1. The spacing P2 between the plurality of second tape binding portions TB2 is a spacing within a single second bundle of sheets SS2.

With the configuration, the spacing between the plurality of tape binding portions TB is changed to be distributed in the sheet edge direction (for example width W direction) from one bound bundle of sheets to the next bound bundle of sheets to be stacked. In the post-processing device 3 according to the embodiment, the post-processing control unit 26 equally distributes the plurality of tape binding portions TB aligned along one side edge SSa of the bundles of sheets SS to either side of the center of the one side edge SSa which is bound.

According to the configuration, the plurality of tape binding portions TB are separated symmetrically with respect to the bound side edge of the bundle of sheets SS in a direction along the one side edge SSa of the bundle of sheets SS. For that reason, the bundle of sheets SS may be bound in good balance.

In the example in FIG. 8, the post-processing control unit 26 sets the number of the plurality of first tape binding portions TB1 and the number of the plurality of second tape binding portions TB2 to be different from each other. In the modification example, the post-processing control unit 26 sets a difference between the number of first tape binding portions TB1 and the number of second tape binding portions TB2 as one.

According to this configuration, the plurality of tape binding portions TB are distributed with the number of the plurality of tape binding portions TB being changed from bundle to bundle. For that reason, the degree of freedom in setting the tape binding position may be increased compared to when only two tape binding portions TB locations are moved from bundle of sheets to bundle of sheets. That is, the bundle of sheets SS may be bound at an optimal position according to the number of the plurality of tape binding portions TB. The difference in the number of tape binding portions TB may be set as one between the first bundle of sheets SS1 and the second bundle of sheets SS2. For that reason, any change in the binding time and binding strength of the bundle of sheets SS may be reduced. When three or more bundles of sheets SS are stacked, the increase and decrease of the number of tape binding portions TB on the next to be bound bundle of sheets SS one may be repeated.

In the example in FIG. 9, the post-processing control unit 26 makes the spacing P5 between the plurality of first tape binding portions TB1 and the spacing P5 between the plurality of second tape binding portions TB2 the same, but offsets their location from the sheet center CL. The post-processing control unit 26 moves the plurality of tape binding portions TB aligned along one side edge SSa of the bundle of sheets SS closer to one end side of one side edge SSa or to the other end side of the sheets.

According to the configuration, the plurality of tape binding portions TB are moved at equal intervals so that the binding locations are distributed in the stack of bound sheets S. For that reason, the tape binding processing time may be kept constant compared to when the spacing between the plurality of tape binding portions TB is changed. The strengths of the binding of the tape T to the different bundles of sheets SS as a result of employing the plurality of tape binding portions TB may be kept equal.

The embodiment includes the following sheet processing method.

That is, tape binding processing is performed on a bundle of sheets SS obtained by stacking a plurality of sheets and the bundle of sheets SS subjected to the tape binding processing is discharged to the paper discharge tray 25*a*. In the paper discharge tray 25*a*, the first bundle of sheets SS1 and the second bundle of sheets SS2 are stacked on each other. The first tape binding portion TB1 is formed on the first bundle of sheets SS1 and the second tape binding portion TB2 is formed on the second bundle of sheets SS2. In the paper discharge tray 25*a*, the first bundle of sheets SS1 and the second bundle of sheets SS2 are placed stacked on each other. In this case, the first tape binding portion TB1 and the second tape binding portion TB2 are spaced from each other in the sheet surface direction. The sheet surface direction intersects with the stacking direction of the first bundle of sheets SS1 and the second bundle of sheets SS2.

Thus, although the configuration according to one embodiment has been described, a configuration of the sheet processing device is not limited to the example described above. For example, the sheet processing device may be an image forming apparatus including a finisher inside a drum in a casing. For example, when the sheet processing device is a device independent from the image forming apparatus, the sheet processing device may include an operation reception unit. Similar to the control panel 11, the operation reception unit includes various keys, touch panels, or the like receiving the user's operation.

According to at least one of the embodiments described above, the post-processing device 3 includes the tape binding processing unit 24, the paper discharge unit 25, and the post-processing control unit 26. The tape binding processing unit 24 performs the tape binding processing on the bundle of sheets SS obtained by stacking a plurality of sheets S. The paper discharge unit 25 discharges the bundle of sheets SS subjected to the tape binding processing to the paper discharge tray 25*a*. The paper discharge unit 25 places the first bundle of sheets SS1 and the second bundle of sheets SS2 in the paper discharge tray 25*a* stacked on each other. The first tape binding portion TB1 is formed on the first bundle of sheets SS1 and the second tape binding portion TB2 is formed on the second bundle of sheets SS. The post-processing control unit 26 places the first bundle of sheets SS1 and the second bundle of sheets SS2 in the paper discharge tray 25*a* stacked on each other. In this case, the first tape binding portion TB1 and the second tape binding portion TB2 are separated from each other in the sheet surface direction. The sheet surface direction intersects with the stacking direction of the first bundle of sheets SS1 and the second bundle of sheets SS2. The post-processing control unit 26 controls at least one of the tape binding processing unit 24 and the paper discharge unit 25. With this, the first tape binding portion TB1 and the second tape binding portion TB2 are spaced from each other in the sheet surface direction.

With the configuration described above, collapse of the plurality of piled up bundles of sheets SS may be suppressed and sticking of the plurality of piled up bundle of sheets SS to each other at the tape is avoided.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An apparatus for binding together side surfaces of a plurality of sheets, comprising;

a sheet storage tray for receiving a plurality of sheets thereon;

a stop positionable at a first position preventing movement of a plurality of sheets located on the sheet storage tray and a second position allowing movement of the plurality of sheets from the sheet storage tray;

a first roller having a first axis of rotation and a second roller having a second axis of rotations;

a movement unit operatively coupled to at least one of the first and second rollers so as to control the first and second rollers to be spaced from each other by different distances;

a tape binding unit;

a path selector located between the first and second rollers, wherein the path selector is movable to select a first path for the plurality of sheets that are conveyed off the sheet storage tray in a direction apart from the first and second rollers, and a second path for the plurality of sheets that are conveyed off the sheet storage tray toward the tape binding unit, wherein, the first and second rollers comprise outer surfaces, and the outer surface of the second roller is more compliant than the outer surface of the first roller, and the movement unit controls the first and second rollers to be spaced from each other by a first distance at which the plurality of sheets are located between the outer surfaces of the first and second rollers and the plurality of sheets extend inwardly of an indentation formed in the outer surface of the second roller, and by a second distance at which the plurality of sheets are located between the first and second rollers and the indentation is not formed in the outer surface of the second roller.

2. The apparatus of claim 1, wherein one of the first roller and the second roller includes a rotation unit configured to rotate the one of the first and second rollers about its axis in a first direction, and when at least a portion of the plurality of sheets are moved between the first and second rollers spaced from each other by the first distance, the edges of the sheets on at least one side of plurality of sheets are moved with respect to one another to form a side of the plurality of sheets wherein the sides of the individual sheets are offset in a stepwise pattern.

3. The apparatus of claim 2, wherein the rotation unit is further configured to rotate the one of the first and second rollers about its axis in a second direction opposite to the first direction, such the plurality of sheets having sides that are offset in the stepwise pattern is conveyed toward the sheet storage tray.

* * * * *